US005247978A

United States Patent [19]

Silenius et al.

[11] Patent Number: 5,247,978

[45] Date of Patent: Sep. 28, 1993

[54] PROCEDURE AND APPARATUS FOR CONTROLLING A BARKING PROCESS

[75] Inventors: Seppo Silenius; Ari Suominen, both of Lahti, Finland

[73] Assignee: Kone Oy, Helsinki, Finland

[21] Appl. No.: 835,464

[22] PCT Filed: Apr. 29, 1991

[86] PCT No.: PCT/FI91/00125

§ 371 Date: Feb. 26, 1992

§ 102(e) Date: Feb. 26, 1992

[87] PCT Pub. No.: WO91/17030

PCT Pub. Date: Nov. 14, 1991

[30] Foreign Application Priority Data

May 2, 1990 [FI] Finland ..... 902187

[51] Int. Cl.[5] ..... B27L 1/00; B27B 1/00

[52] U.S. Cl. ..... 144/341; 144/208 R; 144/208 B; 144/356; 364/478

[58] Field of Search ..... 364/478, 479; 144/206 R, 208 B, 341

[56] References Cited

U.S. PATENT DOCUMENTS

| | | | |
|---|---|---|---|
| 3,807,469 | 4/1974 | Schnyder | 144/208 B |
| 4,173,239 | 11/1979 | Reiche | 144/208 B |
| 4,445,558 | 5/1984 | Banner et al. | 144/208 B |
| 5,019,123 | 5/1991 | Clarke-Pounder et al. | 144/208 B |

*Primary Examiner*—W. Donald Bray

*Attorney, Agent, or Firm*—Sughrue, Mion, Zinn, Macpeak and Seas

[57] ABSTRACT

Procedure and apparatus for controlling the barking process in a barking drum, which procedure uses measuring devices (13*a*,13*b*,14*a*,14*b*) placed in conjunction with the barking drum (1) to measure the weight of the drum. The measurement signals obtained from the weight measuring devices are used to calculate the degree of fullness of the drum, and this data is used to control the position of the delivery gate of the drum so as to achieve the desired degree of fullness. Moreover, the degree of barking of the logs is monitored, and the barking degree data is used as a basis for the control of the speed of rotation of the drum.

9 Claims, 5 Drawing Sheets

PROCEDURE AND APPARATUS FOR CONTROLLING A BARKING PROCESS

The present invention relates to a procedure and an apparatus for controlling a barking process as defined in the introductory part of claim 1.

Since only a low-quality fibre yield may be obtained from the bark of trees, and because the bark requires the use of plenty of chemicals and causes difficulties with impurities and extractives, logs are debarked before defibration. The need for barking depends primarily on the product aimed at, and also on the equipment and process used for the defibration. The production process for bleached softwood sulphate permits the presence of some bark, whereas the production of groundwood generally requires that the logs be completely debarked. In current practice, pulpwood is mainly barked using barking drums.

The barking drum is a rotating steel cylinder, the logs being fed into the cylinder from one end. The drum is somewhat inclined longitudinally. The rotation of the cylinder sets the logs in motion, causing them to be rubbed against each other so as to detach the bark. At the same time, due to the inclination, the logs move forward in the longitudinal direction and are delivered from the other end of the drum. The bark detached from the logs is removed through elongated bark exit slots in the drum shell.

The aim is to remove bark from the logs so as to achieve the desired barking degree. At the same time, some of the wood itself is rubbed off and crushed. This wood is removed with the bark and constitutes a wood loss. Naturally, the aim is to keep this loss as low as possible. Typically, the wood losses during barking vary between 1.5 . . . 5%, depending on the quality of the wood and the manner of operation of the barking lines.

The degree of debarking of the logs in the barking drum increases as a function of the amount of abrasion they are subjected to (FIG. 1).

The barking capacity of the barking drum for different varieties of wood depends on the dimensions and speed of rotation of the cylinder. A drum of given dimensions will bark a given wood variety to a desired degree of purity (degree of debarking) with a given capacity. In practice, the debarkability of logs varies depending on the wood variety, season of the year, temperature and the solids content of the wood.

To eliminate the effect of temperature, logs may be heated so as to thaw any ice in them either before or after barking or by supplying heat energy into the barking drum in the form of water or steam.

To compensate for the effects of the wood variety, the speed of rotation of the drum is varied. For wood with higher bark adhesion strength, a higher speed is used, and vice versa.

To achieve an efficient and economical barking process, it is important that the degree of fullness of the barking drum is correct. For example, in so-called tumble-barking, which means that the ratio of log length to drum diameter is max. 0.7, the optimal degree of fullness is 50 . . . 60%. In this case the rubbing action between the logs is at its strongest and the desired barking degree is reached in a minimum of time. Also, the wood loss occurring during barking is at its minimum. This is shown by investigations made by Piggott and Thompson (article R. R. Piggott; L. A. Thompson: TAPPI Pulping Conference 1986).

In practice, controlling the feed, discharge and degree of fullness of the barking drum on the basis of the operator's observations and control actions leads to fluctuations causing variations in the degree of barking and high wood losses.

The present invention allows automatization of the control of the barking drum and the equipment used in conjunction with it. The invention allows automatic adjustment of the feed capacity of the drum, supply of thawing energy, speed of rotation of the drum and the position of the delivery gate controlling the discharging of the drum. The features characteristic of the invention are presented in the claims.

In the following, the invention is described in detail by the aid of an example by referring to the drawings in which FIG. 1 represents the degree of barking of the logs as a function of the amount of abrasion work applied.

FIGS. 2*a*–2*c* illustrate the barking drum unit.

Figure 1:
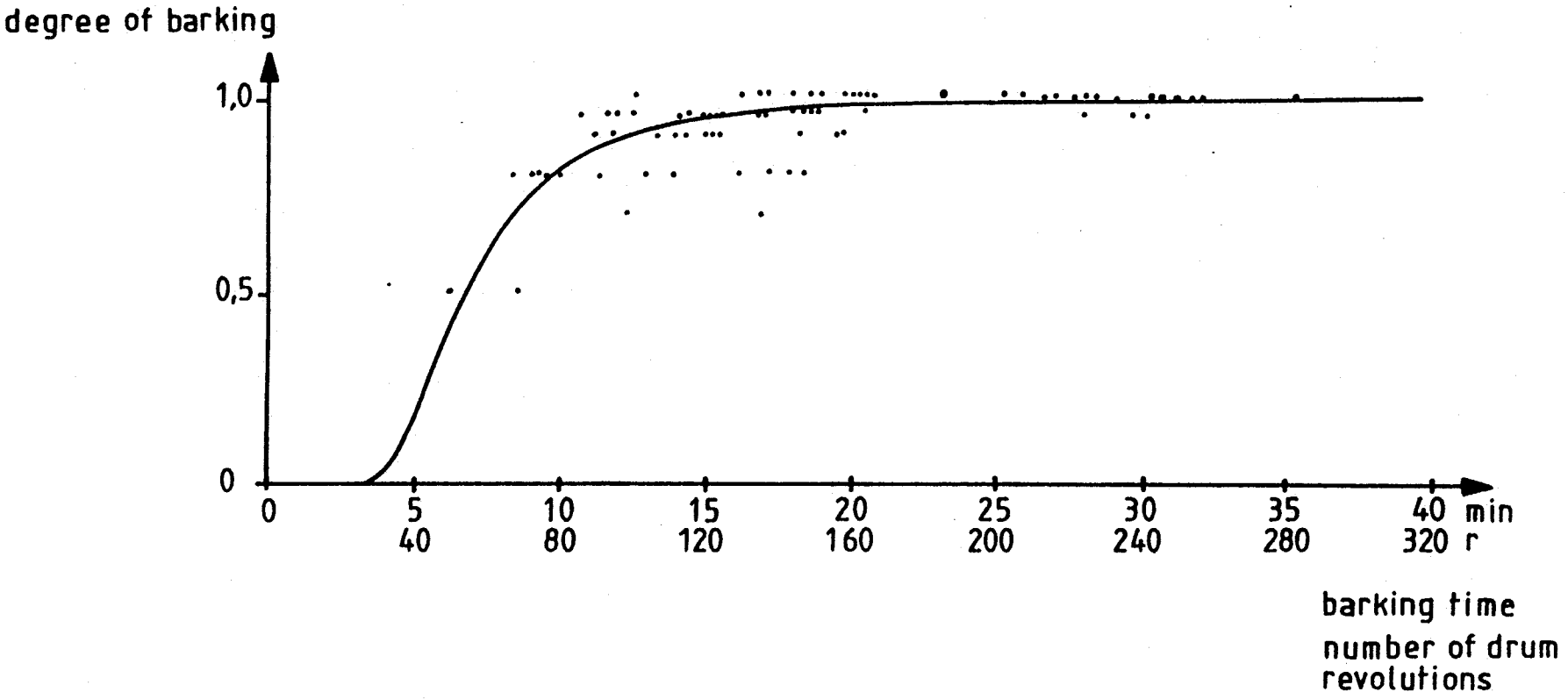

In FIG. 1, the amount of abrasion work is represented by the barking time and rotational speed of the drum, shown on the horizontal axis. It can be seen from the curve describing the degree of barking, which is based on points of observation, that the degree of barking of the logs increases as a function of the amount of abrasion work applied to them, as stated above.

Figure 2A:
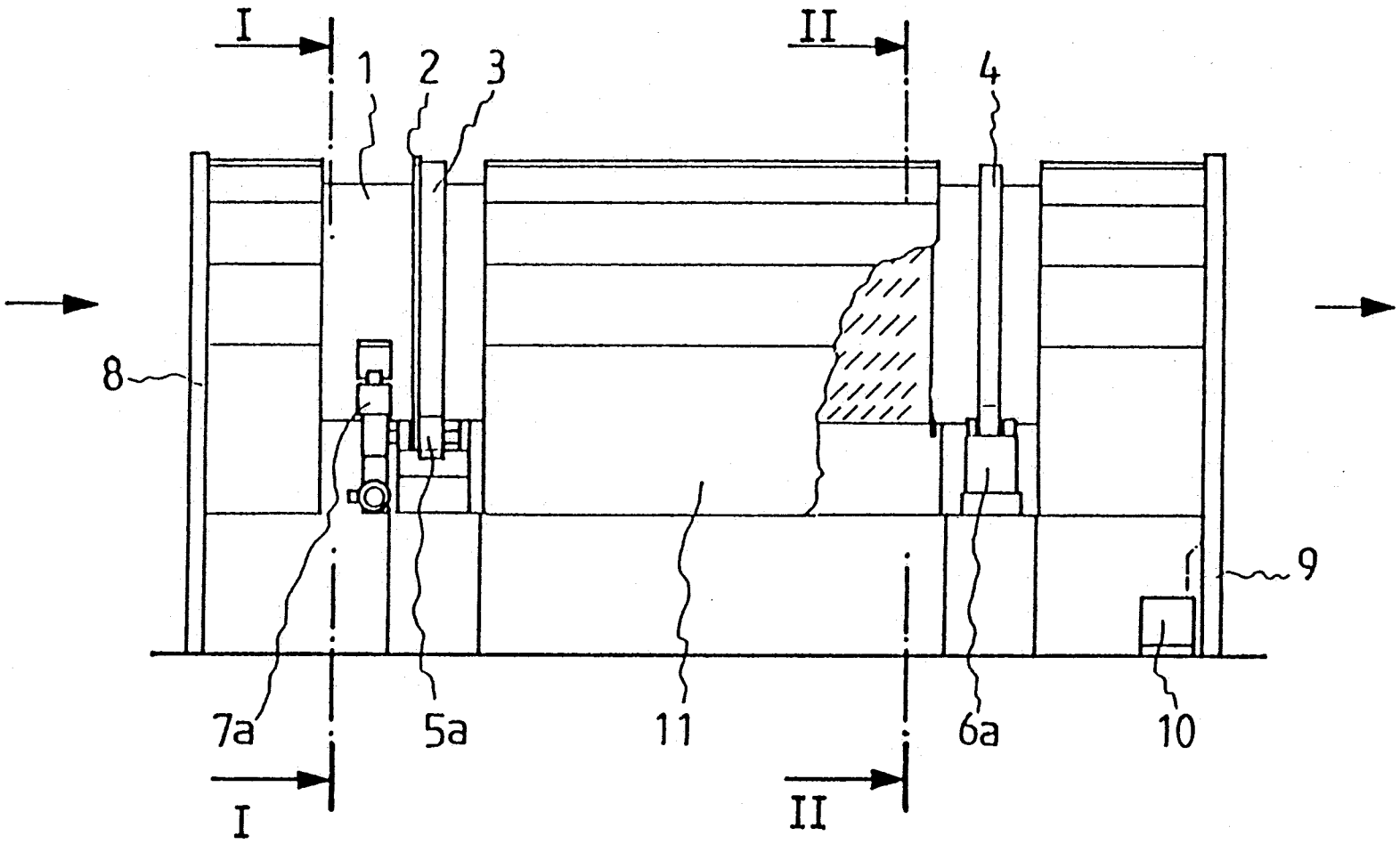
Figure 2C:
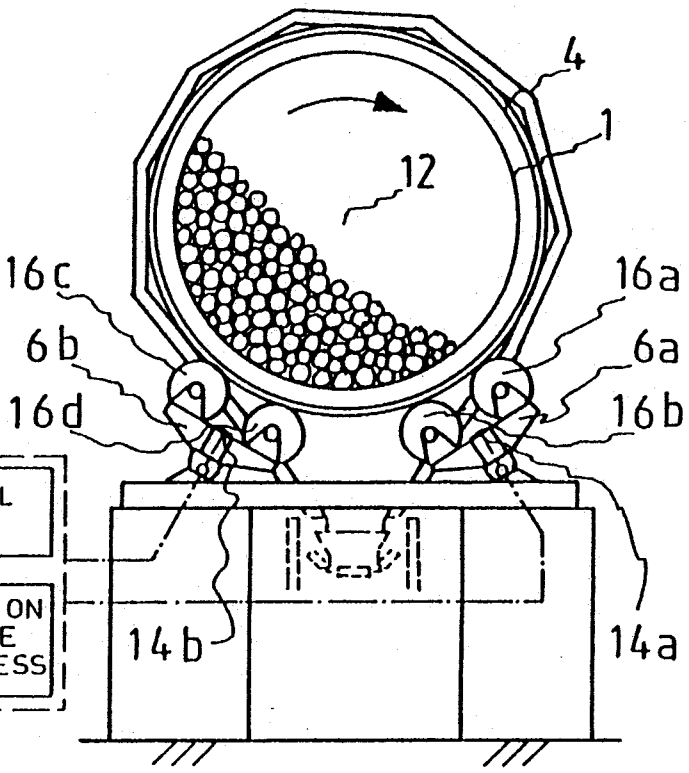

As shown in FIG. 2*a*, the barking drum unit comprises a drum shell 1, a main gear ring 2, supporting rings 3 and 4, supporting structures 5*a* and 6*a* provided with supporting wheels and guide rollers, motor drives 7*a* rotating the drum, a feed end 8, a delivery end 9, a discharge gate 21, a hydraulic unit 10 for actuating the discharge gate, and a bark conveyor 11. The logs move from left to right as indicated by the arrows.

Figure 2B:
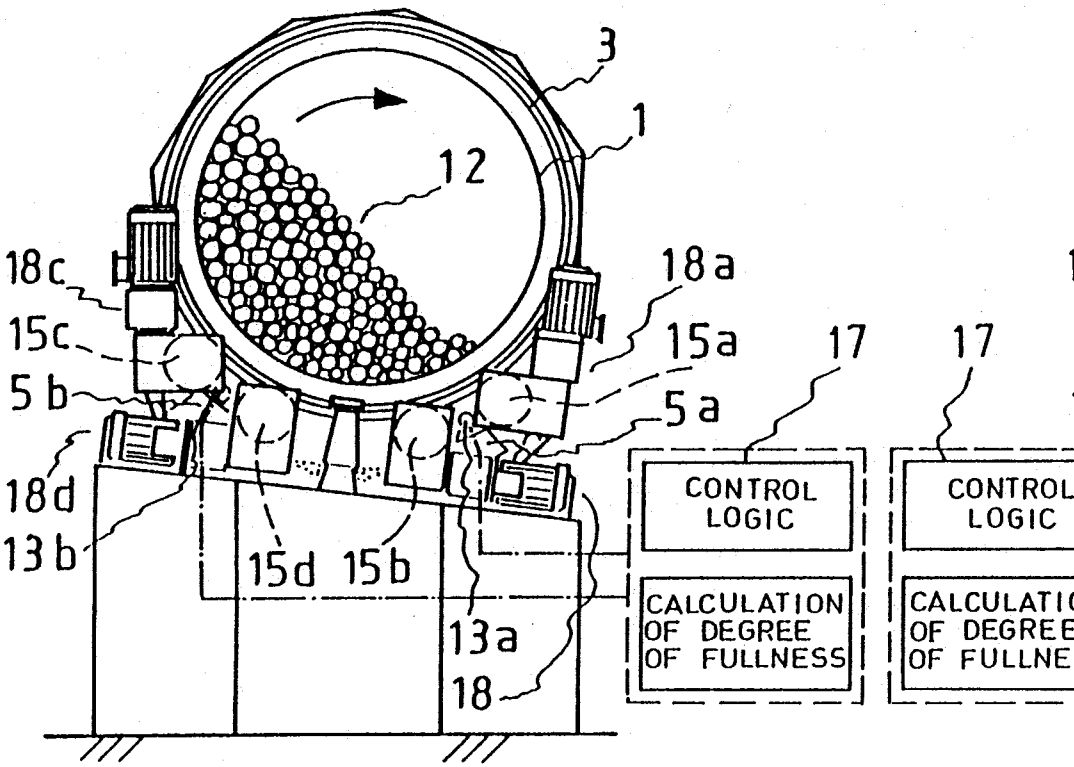
Figure 3:
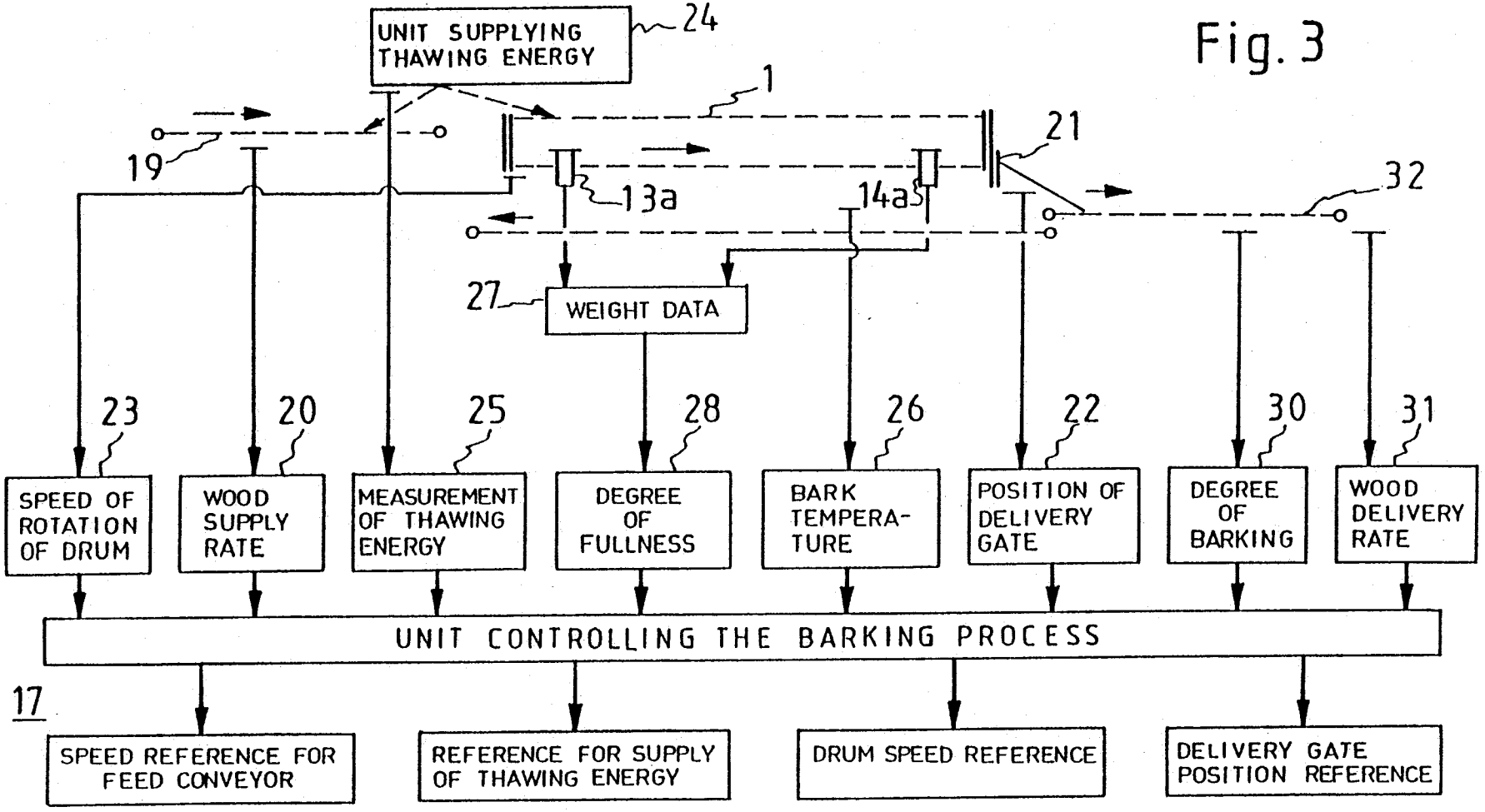
FIG. 3 illustrates the principle of automatic control of a barking process by the procedure of the invention.

The barking drum is typically a cylinder 1 rotating on two bearings as indicated by the arrow in FIGS. 2*b* (section I—I) and 2*c* (section II—II), inside which the logs 12 move. The drum is provided with devices 13*a*, 13*b*, 14*a* and 14*b* measuring the supporting forces in the supporting structures 5*a*, 5*b*, 6*a* and 6*b*. These devices are placed in the upper part of the supporting structures in such a way that measuring device 13*a* is between the supporting wheels 15*a* and 15*b* belonging to supporting structure 5*a* and, similarly, measuring device 13*b* is between the supporting wheels 15*c* and 15*d* belonging to supporting structure 5*b*. In corresponding manner, measuring devices 14*a* and 14*b* are placed in supporting structures 6*a* and 6*b* between the supporting wheels 16*a* and 16*b* belonging to them. The measuring devices 13*a*, 13*b*, 14*a* and 14*b* produce an electric measurement signal, which is fed into a computer 17 which is provided with control logic and performs the required calculations to determine the degree of fullness. Placed in the supporting structures 5*a* and 5*b* of one of the bearings are motor drives 18*a* and 18*b* provided with inverters and serving to rotate the barking drum. Power transmission from the motors to the barking drum occurs via the main gear ring 2.

The conveyor 19 feeding the drum is provided with capacity measurement 20 for measuring e.g. the weight of the logs on the conveyor and the conveyor speed. The discharge gate 21 of the drum is provided with means 22 for position indication. Furthermore, the drum is provided with a unit 23 for measuring the speed of rotation and a unit 25 for measuring the supply 24 of thawing energy. Placed in conjunction with the bark conveyor 11 below the drum is a unit 26 for measuring the bark temperature.

Figure 4:
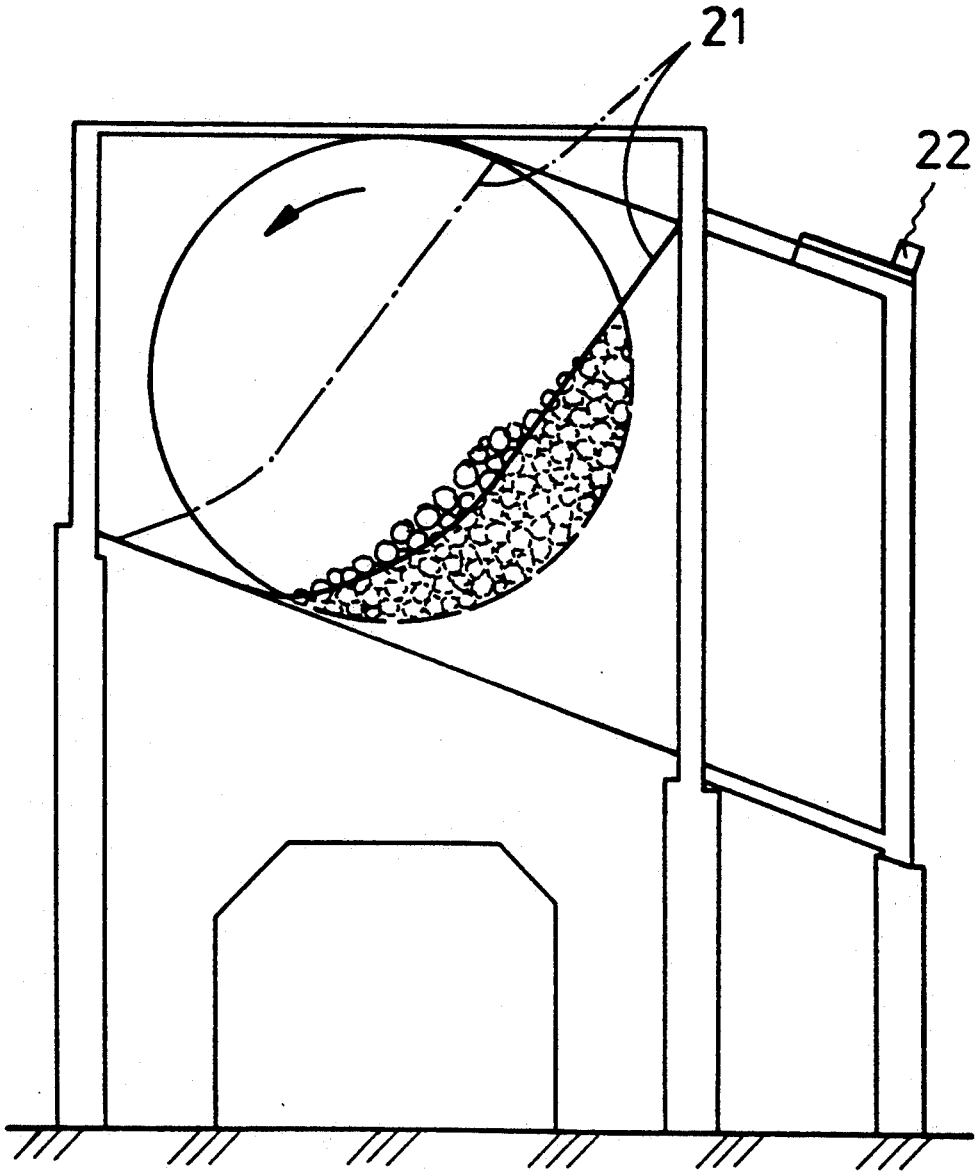
FIG. 4 shows a barking drum unit as seen from that end where the delivery gate is located.

The weight data 27 for each drum end, obtained from the supporting structures 5*a*, 5*b*, 6*a* and 6*b* of the drum, are passed to a computer 17 which calculates the degree of fullness of the drum on the basis of the log distribution, determined by the aid of information as to the density and degree of packing. Based on the the degree of fullness, the computer 17 controls the position of the discharge gate 21 so as to maintain a desired constant degree of fullness even when the feed capacity or speed of rotation of the drum varies. Before the drum is brought into use, the initial discharge gate position required by the intended degree of fullness is determined by performing trial runs with the equipment. The gate position data is obtained from the position indicator, which consists of, for example, a potentiometer 22 connected with the gate 21 by means of a thin thread (FIG. 4). As the gate moves, it pulls or releases the thread, so that the potentiometer 22 is rotated correspondingly as a function of the gate position. In FIG. 4, the dotted broken line indicates the gate position corresponding to the amount of logs shown in the figure. Temporary changes in the degree of fullness can also be achieved by controlling the feed conveyor.

The bark temperature data is used to control the supply of thawing energy. This is also dependent on the data representing the degree of barking, which may prevent the supply of energy if the degree of barking is sufficient. The degree of barking can be determined by visual estimation by the operator, who inputs an estimate via the computer according to predefined rules. The degree of barking can also be determined automatically by using a CCD camera and image processing techniques known in themselves.

The speed of rotation and feed capacity of the drum are utilized to achieve the desired degree of barking. This is done by operating the drum at a predetermined feed capacity and controlling the rotational speed in such a way that the desired degree of barking is achieved. The drum speed is controlled by means of the speed reference of the motor drives, which is given an initial value obtained on the basis of trials. By measuring the wood delivery rate 31, it is also possible to control the drum speed so as to reduce the variations in the amounts of wood delivered onto the conveyor 32.

It is obvious to a person skilled in the art that different embodiments of the invention are not restricted to the examples described above, but that they may instead be varied within the scope of the claims presented below.

We claim:

1. A procedure for controlling a log barking process in a barking drum, said procedure comprising:
   calculating the degree of fullness of the drum by means of measurement signals obtained from at least one weight measuring device operably disposed in conjunction with said barking drum;
   controlling the position of a discharge gate of said drum in response to said calculated degree of fullness so as to achieve a predetermined degree of fullness;
   determining the degree of barking of the logs by monitoring the barking of the logs; and
   controlling the speed of rotation of said drum in response to the determined degree of barking.

2. A procedure according to claim 1, wherein the degree of fullness is calculated from measurement signals obtained from said at least one weight measuring device and from data representing the density and degree of packing of the logs.

3. A procedure according to claim 1, wherein the speed of rotation is controlled to achieve a predetermined barking capacity.

4. A procedure according to claims 1, 2 or 3, further including:
   measuring the temperature of the bark; and
   controlling the supply of energy needed for thawing of the logs in response to the data representing the bark temperature and data representing the degree of barking.

5. An apparatus for controlling a barking process in a barking drum, said apparatus comprising:
   a barking drum having a discharge gate;
   means for supporting and rotating said drum;
   at least one device for measuring the weight of said drum, said at least one device disposed in conjunction with said barking drum;
   a computer having input and output means;
   position determining means for determining the position of said discharge gate of said drum;
   means for inputting to said computer measurement signals obtained from said at least one weight measuring device to permit calculation of the degree of fullness;
   means for outputting from said computer a control signal for controlling the position of said discharge gate of said drum; and
   means for controlling by said computer the rotation speed of said drum in response to data representing the degree of barking.

6. An apparatus according to claim 5, further comprising:
   monitoring means for monitoring the degree of barking, said monitoring means disposed in conjunction with the bark conveyor of the barking drum;
   wherein an output signal from said monitoring means is input to said computer.

7. An apparatus according to claim 6, wherein said monitoring means comprises a CCD camera.

8. An apparatus according to claims 5 or 6, further comprising:
   means for supplying thawing energy for thawing logs; and
   temperature measuring means for measuring the temperature of the bark;
   wherein said computer controls the supply of energy used for thawing the logs in response to data representing the degree of barking and the bark temperature.

9. An apparatus according to claims 5 or 6, wherein said at least one weight measuring device is disposed in the supporting structure of said barking drum.

* * * * *